US006138756A

United States Patent [19]

Dale

[11] Patent Number: 6,138,756

[45] Date of Patent: Oct. 31, 2000

[54] MILLING GUIDE HAVING ORIENTATION AND DEPTH DETERMINATION CAPABILITIES

[75] Inventor: Dana R. Dale, Houston, Tex.

[73] Assignee: Halliburton Energy Services, Inc., Dallas, Tex.

[21] Appl. No.: 09/005,393

[22] Filed: Jan. 9, 1998

[51] Int. Cl.[7] ..... E21B 7/06

[52] U.S. Cl. ..... 166/254.2; 166/50; 166/313; 166/117.5; 166/255.3

[58] Field of Search ..... 166/50, 117.5, 166/117.6, 255.1, 255.3, 254.1, 254.2, 298, 313, 65.1

[56] References Cited

U.S. PATENT DOCUMENTS

| | | | |
|---|---|---|---|
| 5,379,845 | 1/1995 | Blount et al. | 166/382 |
| 5,462,120 | 10/1995 | Gondouin | 166/380 |
| 5,595,247 | 1/1997 | Braddick | 166/297 |
| 5,697,445 | 12/1997 | Graham | 166/313 |

FOREIGN PATENT DOCUMENTS

| | | |
|---|---|---|
| 2297779 | 8/1996 | United Kingdom . |
| 2297988 | 8/1996 | United Kingdom . |
| 2304764 | 3/1997 | United Kingdom . |
| WO97/12113 | 4/1997 | WIPO . |

*Primary Examiner*—David Bagnell
*Assistant Examiner*—Zakiya Walker
*Attorney, Agent, or Firm*—William M. Imwalle; Marlin R. Smith

[57] ABSTRACT

A milling guide assembly includes features permitting a milling guide to be accurately positioned within a subterranean well. In a described embodiment, a milling guide has a logging tool attached thereto and a wireline extending through the milling guide. When the milling guide has been positioned and anchored within the well, the wireline is detached from a weak point disposed between the milling guide and the logging tool. The wireline is then withdrawn from the milling guide.

13 Claims, 9 Drawing Sheets

MILLING GUIDE HAVING ORIENTATION AND DEPTH DETERMINATION CAPABILITIES

BACKGROUND OF THE INVENTION

The present invention relates generally to equipment and operations utilized in conjunction with subterranean wells and, in an embodiment described herein, more particularly provides a milling guide having orientation and depth determination capabilities.

It is well known in the art to position a whipstock or milling guide within a tubular structure within a subterranean well, so that a cutting tool, such as a drill or mill, may be guided to cut into the tubular structure. Where this operation is performed from a land rig, or from a rig otherwise secured to the earth's surface, positioning of the milling guide may be accurately accomplished using conventional equipment and techniques well known to those of ordinary skill in the art. However, where the operation is performed from a floating rig, or other rig not rigidly secured to the earth's surface, accurate positioning of the milling guide presents several problems. This is particularly so where an opening must be formed through the tubular structure and aligned with another structure disposed externally to the tubular structure.

For example, it is known to mill an opening through a portion of a liner overlying a whipstock positioned in a lower parent wellbore, in order to provide access and fluid communication between the lower parent wellbore, an upper portion of the parent wellbore, and a lateral wellbore intersecting the parent wellbore. A milling guide may be lowered into the liner from the earth's surface and positioned relative to the whipstock, using the depth from the rig floor or sea floor to correlate the milling guide's position relative to the whipstock's position. Unfortunately, when the rig floor displaces with respect to the earth's surface, such as on a floating rig, it is difficult to correlate the milling guide's position relative to the whipstock's position. This is due to the fact that the milling guide is suspended from the rig, while the whipstock is anchored to the earth.

Past attempts to remedy this problem have been only marginally successful. In one technique, the milling guide is conveyed into the liner below the whipstock suspended from a drill string, and a logging tool is separately conveyed through the drill string and used to determine the depth and orientation of the milling guide relative to the whipstock. The milling guide is rotated as needed to orient it toward the whipstock. The logging tool is then withdrawn from the drill string, and the milling guide is raised as needed to position the milling guide opposite the whipstock.

Of course, the rig may move between the time the desired depth of the milling guide is determined, and the time at which the milling guide is raised relative to the whipstock. Note that a significant delay may occur between these times, since the wireline and logging tool are removed from the well before the milling guide is repositioned. Additionally, the orientation of the milling guide may change due to the drill string being displaced within the well.

From the foregoing, it can be seen that it would be quite desirable to provide a milling guide which has orientation and depth determination capabilities for use on floating rigs, so that the milling guide may be directly positioned relative to a structure disposed within a well. Additionally, such a milling guide, or other similarly improved item of equipment, may be suspended from other types of rigs and used in other operations in which it is desired to position the milling guide or other item of equipment in a well. It is accordingly an object of the present invention to provide such a milling guide and associated methods of positioning the milling guide within a well.

SUMMARY OF THE INVENTION

In carrying out the principles of the present invention, in accordance with an embodiment thereof, a milling guide assembly is provided which includes a milling guide having a logging tool attached thereto, utilization of which does not require that the milling guide be repositioned after the logging tool has been retrieved from the well, but which permits accurate and convenient positioning of the milling guide.

In broad terms, a milling guide is provided which has a wireline extending therethrough. The wireline is operatively connected to a logging tool attached below the milling guide. A weak point is used between the wireline and the logging tool, to permit the wireline to be detached from the logging tool after the milling guide has been positioned. The wireline may then be withdrawn from the well.

In another aspect of the present invention, a releasable coupling is attached to the milling guide. The releasable coupling permits a drill string or other tubular conveyance to be releasably attached to the milling guide. In the illustrated embodiment of the invention, an upper portion of the releasable coupling is a hydraulic running tool having the wireline sealingly disposed therein and extending therethrough. A lower portion of the releasable coupling is an anchoring device for anchoring the milling guide within the well.

In yet another aspect of the present invention, a wireline wet connect is attached above the releasable coupling. The wet connect permits another wireline to be operatively connected to the wireline extending through the milling guide to the logging tool, after the milling guide has been conveyed into the well. In this manner, the milling guide may be positioned accurately within the well while the wireline is attached thereto. The milling guide may then be anchored in position prior to withdrawing the wireline from the well.

In still another aspect of the present invention, the milling guide is positioned with respect to a whipstock disposed externally relative to a liner extending into a lateral wellbore intersecting a parent wellbore. The positioning is accomplished by using the logging tool to detect a marker attached to the whipstock. For further convenience in positioning the milling guide, the marker may be secured a distance from an opening to be formed in the whipstock, which distance is equal to the distance between a detector portion of the logging tool and a guide surface of the milling guide.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
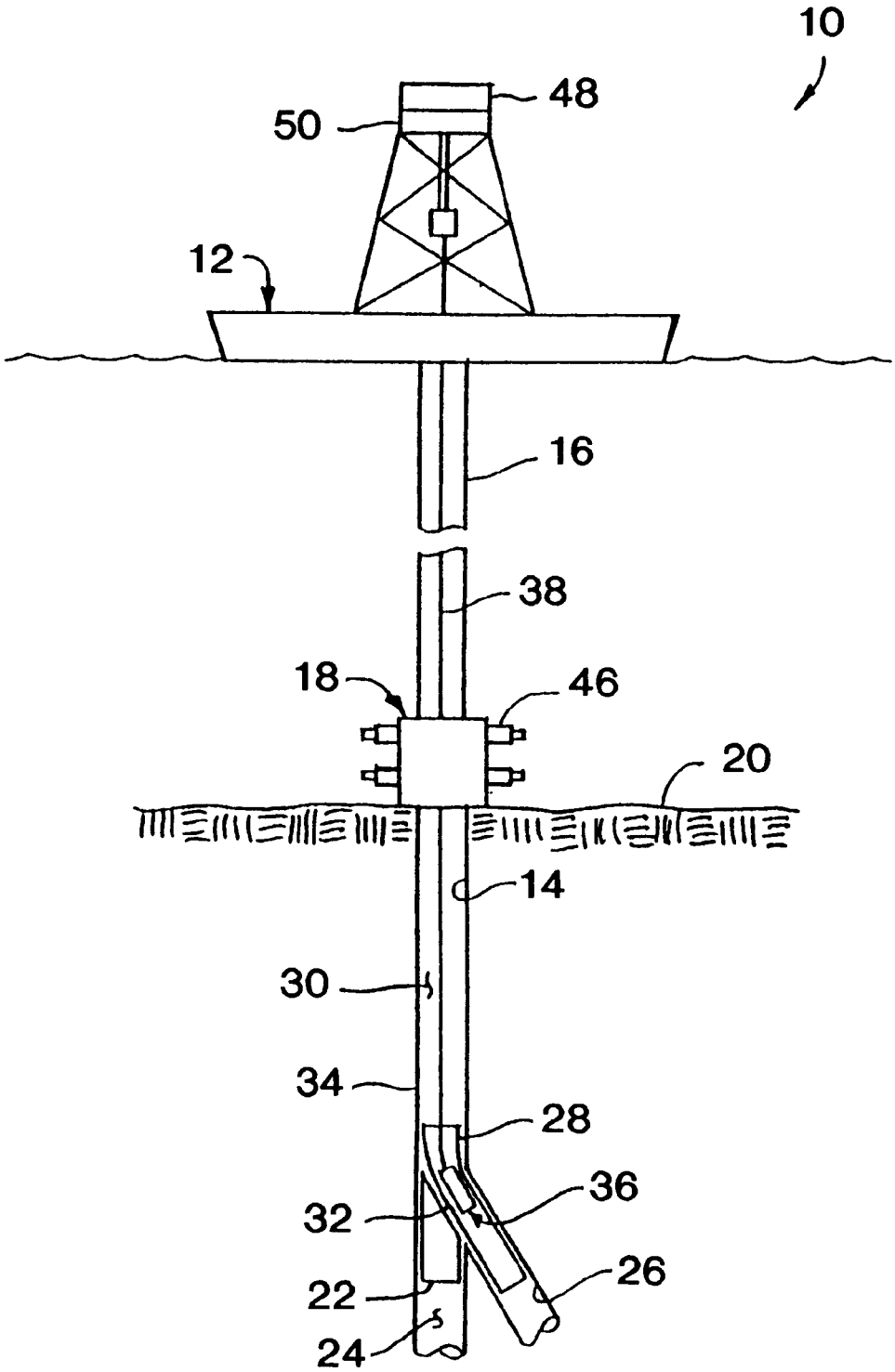
FIG. 1 is a schematic view of a method of orienting and positioning a milling guide assembly within a subterranean well, the method and the milling guide assembly each embodying principles of the present invention.

Representatively and schematically illustrated in FIG. 1 is a method 10 which embodies principles of the present invention. In the following description of the method 10, and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The method 10 is described herein as being performed from a floating rig 12, but it is to be clearly understood that methods incorporating principles of the present invention may be performed from other types of rigs, including rigs rigidly secured to the earth's surface. The rig 12 is connected to a parent wellbore 14 of the well via a tubular riser 16 extending from the rig to a BOP stack 18 on the sea floor 20.

A whipstock 22 has been anchored in a lower portion 24 of the parent wellbore 14, and a lateral wellbore 26 has been drilled extending outwardly from the parent wellbore by deflecting cutting tools, such as one or more mills and/or drill bits, etc., (not shown in FIG. 1) laterally off of the whipstock 22. A tubular liner 28 has then been lowered through an upper portion 30 of the parent wellbore 14 and deflected off of the whipstock 22 into the lateral wellbore 26, so that the liner is received upwardly in the upper parent wellbore and downwardly in the lateral wellbore. The liner 28 is then cemented in place, thereby sealing the intersection of the parent and lateral wellbores 14, 26.

It will be readily appreciated that, if access and fluid communication are to be provided to and with the lower parent wellbore 24, an opening should be formed through a portion 32 of the liner 28, which overlies the whipstock 22 and extends laterally across the parent wellbore 14. Additionally, this opening should be formed axially through the whipstock 22, with the opening having a diameter large enough to pass equipment therethrough for servicing the lower parent wellbore 24. Thus, the opening should be accurately centered with respect to the whipstock 22, so that the opening may have as large a diameter as is feasible, without cutting into protective casing 34 lining the parent wellbore 14, and so that the opening will be axially aligned with the parent wellbore.

In order to accomplish these objectives, a milling guide assembly 36 is conveyed into the well suspended from a tubing string 38. As used herein, the term "tubing string" and similar terms indicate a string of tubular material, whether continuous or segmented, such as drill pipe, production tubing, coiled tubing, etc. The milling guide assembly 36 is conveyed into the liner 28 and positioned relative to the whipstock 22, so that a guide surface 4) of the milling guide assembly (not shown in FIG. 1, see FIGS. 2 and 3A–3K) is aligned with the liner portion 32 overlying the whipstock.

A logging tool 42 of the milling guide assembly 36 (see FIGS. 2 and 3A–3K) permits accurate positioning of the milling guide assembly relative to the whipstock 22 in a manner that will be more fully described below. During the positioning of the milling guide assembly 36 relative to the whipstock 22, a wireline 44 extending to the earth's surface is operatively connected to the logging tool 42. When the milling guide assembly 36 has been positioned with respect to the whipstock 22, the milling guide assembly is anchored in place in the liner 28, and the tubing string 38 is retrieved from the well, leaving a lower portion of the milling guide assembly anchored in place. Cutting tools may then be guided by the milling guide assembly 36 to cut through the liner portion 32 and through the whipstock 22. She milling guide assembly 36 may then be milled through or retrieved from the well using conventional techniques.

In order to restrict displacement of the tubing string 38 in the well during positioning of the milling guide assembly 36 relative to the whipstock 22, an annular preventer 46 of the BOP stack 18 may be closed about the tubing string, thereby permitting the rig drawworks and motion compensator (schematically represented at 48 and 50, respectively) to compensate for motion between the rig and the sea floor 20 without significantly affecting the position of the milling guide assembly. When the milling guide assembly 36 has been positioned with respect to the whipstock 22, and the milling guide assembly has been anchored within the liner 28, the annular preventer 46 may be reopened, and the wireline 44 and tubing string 38 may be released from the lower portion of the milling guide assembly and retrieved from the well. Of course, these steps should be appropriately modified if the rig 12 is rigidly secured to the earth.

Note that the method 10 permits the depth and orientation of the milling guide assembly 36 relative to the whipstock 22 to be directly determined (since the wireline 44 is operatively connected to the logging tool 42 during this step) immediately prior to the milling guide assembly being anchored in position within the liner 28. There is no delay needed to remove the logging tool 42 from the well, or to reposition the milling guide assembly 36 after the logging tool has been removed. Thus, the method 10 produces significantly more accurate positioning of the milling guide assembly 36, while being more convenient in its performance than prior methods.

Figure 2:
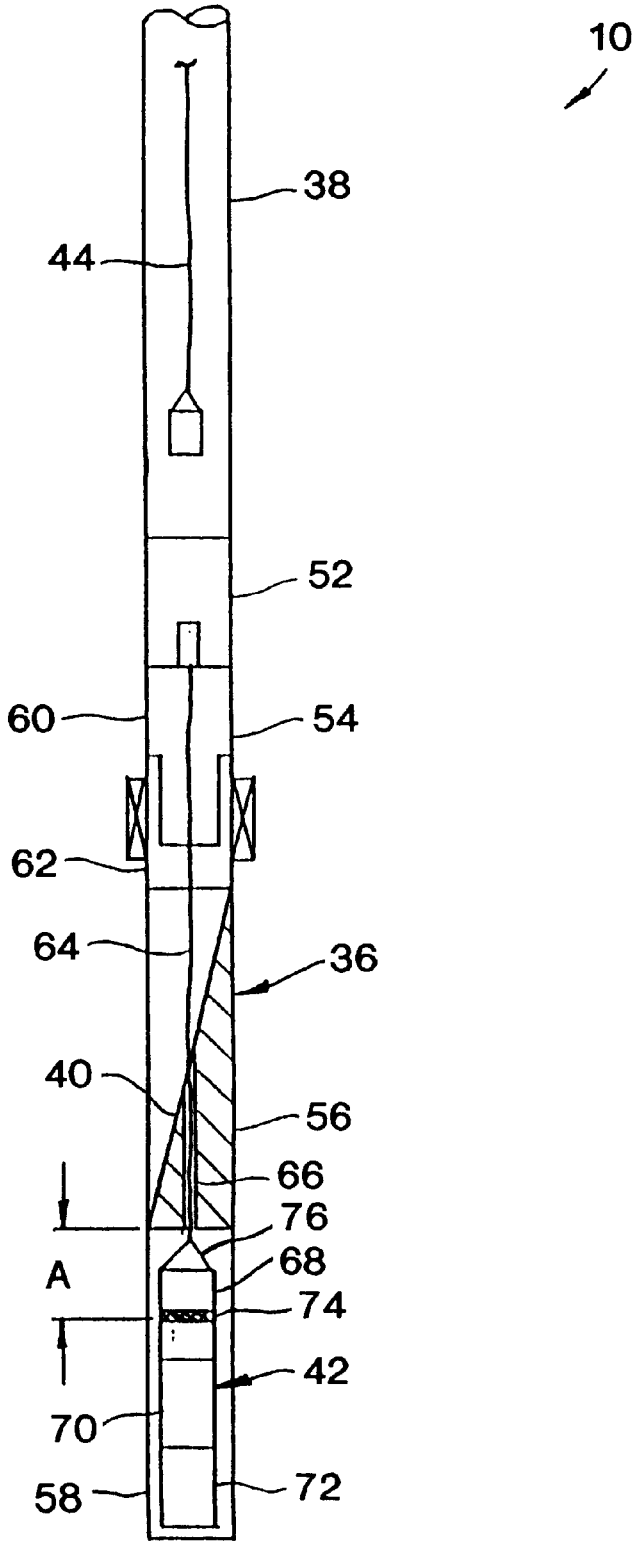
FIG. 2 is an enlarged schematic view of the milling guide assembly of FIG. 1.

Referring additionally now to FIG. 2, an enlarged view of the milling guide assembly 36 is schematically and representatively illustrated. FIG. 2 shows the milling guide assembly 36 attached to the tubing string 38, with the wireline 44 being lowered through the tubing string to a wireline wet connect sub 52 of the milling guide assembly. Therefore, FIG. 2 shows the milling guide assembly 36 after it has been conveyed into the liner 28, but before it has been positioned relative to the whipstock 22.

The milling guide assembly 36 includes the wet connect 52, a releasable coupling 54, a milling guide 56, the logging tool 42, and a housing 58 attached to the milling guide 56. The wet connect 52 is of the type well known to those skilled in the art, which permits a wireline to be operatively connected to a tool downhole, with the connection being made surrounded by fluid. As used herein, the term "milling guide" and similar terms indicate a device or apparatus used to deflect or otherwise guide a cutting tool to cut through another member, and includes whipstocks and other deflecting devices. As used herein, the term "wireline" and similar terms indicate one or more electrical conductors, such as the type of multiple conductor armored wireline used to convey and communicate with logging tools, or a single conductor electric line, etc.

An example of a suitable wet connect 52 for use in the method 10 is the E400-120 Connector Sub available from (Gearhart Industries, Inc. of Fort Worth, Tex. Preferably, the wet connect 52 is adapted to be connected to the releasable coupling 54 of the milling guide assembly 36. However, it is to be clearly understood that other wet connect subs, and other means of connecting the wireline 44 to the milling guide assembly 36 may be utilized, without departing from the principles of the present invention. For example, the tubing string 38 could be coiled tubing having a wireline or other electrical conductor installed therein when the milling guide assembly 36 is conveyed into the liner 28, and, after the milling guide 56 has been positioned relative to the whipstock 22 and anchored in the liner, the combined coiled tubing and wireline could be retrieved from the well.

The releasable coupling 54 is interconnected between the wet connect 52 and the milling guide 56. As representatively illustrated, the releasable coupling 54 includes an upper portion 60 and a lower portion 62. In a unique feature of the present invention, the releasable coupling 54 has a lower wireline portion 64 sealingly disposed therein, the lower wireline extending through the releasable coupling and being interconnected between the wet connect 52 and the logging tool 42.

The upper coupling portion 60 in the illustrated embodiment is a hydraulically-operated running tool, which is used in setting the lower coupling portion 62. The lower coupling portion 62 in the illustrated embodiment is an anchoring device, which is used in the method 10 to anchor the milling guide assembly 36 in the liner 28. A first predetermined fluid pressure is applied to the running tool 60 to set the anchoring device 62, and then a second predetermined fluid pressure, greater than the first predetermined fluid pressure, is applied to the running tool to release the running tool for displacement relative to the anchoring device.

These fluid pressures are applied by circulating fluid through the tubing string 38 and through a restrictive orifice in the running tool 60. An increased rate of fluid circulation produces a correspondingly increased fluid pressure in the interior of the running tool 60. As the fluid pressure in the interior of the running tool 60 increases, a corresponding increase in the fluid pressure differential from the interior to the exterior of the running tool is produced. The fluid pressure differential is first used to set the anchoring device 62, and then an increased fluid pressure differential is used to decouple the running tool 60 from the anchoring device, so that the tubing string 38, wet connect 52 and running tool may be retrieved from the well.

The milling guide 56 is uniquely configured with the lower wireline 64 extending therethrough. For this purpose, an opening 66 is formed axially through the milling guide 56, the opening intersecting the laterally inclined guide surface 40. Thus, while the milling guide assembly 36 is being conveyed into the liner 28 and positioned relative to the whipstock 22, the lower wireline 64 is disposed in the opening 66, operatively connecting the logging tool 42 to the wet connect 52. In a manner that will be more fully described below, the lower wireline 64 is removed from the milling guide 56 when the running tool is decoupled from the anchoring device 62 and retrieved from the well.

The logging tool 42 is of generally conventional construction. In the illustrated embodiment, the logging tool 42 includes a gamma ray tool 68, a collar locator 70 and a gyroscope 72. Of course, other logging tools, other types of logging tools, and different quantities of logging tools may be used in the milling guide assembly 36 without departing from the principles of the present invention. For example, the collar locator 70 is not necessary, and the gyroscope 72 could be replaced with a gravity-type high side indicator, etc. A suitable logging tool 42 for use in the milling guide assembly 36 is available from Scientific Drilling of Houston, Tex.

The gamma ray tool 68 includes a sensor location 74. In a unique aspect of the present invention, the logging tool 42 is attached to the milling guide 56, so that the sensor location 74 is positioned a predetermined distance 'A' from the guide surface 40. In a manner that will be more fully described below, such positioning of the sensor location 74 enables accurate and convenient positioning of the guide surface 40 relative to the whipstock 22.

The gyroscope 72 is used to orient the guide surface 40 relative to the liner portion 32 and whipstock 22. If it is known that the liner portion 32 and whipstock 22 are on the low side (or high side) relative to the liner 28, a gravity-type high side indicator may be used in place of the gyroscope. As another alternative, the gamma ray tool 68 may be made directional by shielding its sensor, so that it provides a greater signal when the sensor is oriented toward the target. Thus, the gyroscope 72 may be replaced by a specially configured gamma ray tool 68, and any of the logging tools described herein may be replaced by other tools, or eliminated, added to, etc., without departing from the principles of the present invention.

The logging tool 42 is secured within the housing 58, which is attached to the milling guide 56. The lower wireline 64 extends through the opening 66 and into the housing 58, where it is connected to the logging tool 42 using a conventional rope socket 76. Thus, the rope socket 76 operatively connects the lower wireline 64 to the logging tool 42 below the milling guide 56.

It will be readily appreciated by a person of ordinary skill in the art that the rope socket 76 may serve as a weak point for attachment of the lower wireline 64. That is, the lower wireline 64 may be separated from the logging tool 42 by applying a sufficiently great upwardly directed force to the lower wireline, thereby detaching the lower wireline at the rope socket 76. The lower wireline 64 may then be removed from the milling guide 56 by withdrawing it upwardly therefrom, leaving the rope socket 76 and logging tool 42 in the housing 58.

In the method 10, the lower wireline 64 is detached from the rope socket 76 and withdrawn from the milling guide 56 after the anchoring device 62 has been set in the liner 28 and the running tool 60 has been decoupled from the anchoring device. Upward displacement of the tubing string 38 is used to detach the lower wireline 64 from the rope socket 76 and retrieve the lower wireline from the well with the tubing string.

It will now be fully appreciated that each of the items of equipment shown in FIG. 2 performs one or more functions in the method 10. The tubing string 38 conveys the milling guide assembly 36 into the well, serves as a fluid passageway for circulating fluid through the running tool 60, and serves as a conduit for transporting the wireline 44 between the earth's surface and the wet connect 52. The wet connect 52 permits electrical interconnection of the wireline 44 with the lower wireline 64.

The running tool 60 releasably attaches the tubing string 38 to the remainder of the milling guide assembly 36 below the running tool, cooperatively engages the anchoring device 62 for setting the anchoring device, and sealingly engages the lower wireline 64. The anchoring device 62 anchors the milling guide 56 in position in the liner 28, releasably couples to the running tool 60, and provides a debris barrier during milling operations, which will be described more fully below. The milling guide 56 provides the guide surface 40 for deflecting cutting tools to cut through the liner 28, and serves as a conduit for the lower wireline 64.

The logging tool 42 produces output useful in determining the relative distance between the milling guide 56 and the whipstock 22, determining the depth of the milling guide assembly, and determining the orientation of the guide surface 40 relative to the whipstock. The rope socket 76 operatively interconnects the lower wireline 64 and the logging tool 42, and serves as a weak point between the lower wireline and logging tool. The housing 58 securely attaches the logging tool 42 to the milling guide 56, and spaces the sensor location 74 the predetermined distance 'A' from the guide surface 40 or other portion of the milling guide assembly 36.

Of course, a method embodying principles of the present invention may be performed utilizing an assembly including more, less or different elements, and each of the elements may perform more, less or different functions, as compared to those listed above. Additionally, a milling guide or other item of equipment may be conveyed into a well and accurately positioned therein using an assembly embodying principles of the present invention, which assembly includes more, less or different elements, with each of the elements performing more, less or different functions, as compared to those listed above.

Referring additionally now to FIGS. 3A–3K, a representative embodiment of the milling guide assembly 36 is illustrated in successive axial sections. Note that the wet connect 52 is not shown in FIGS. 3A–3K. However, it is to be understood that the wet connect 52 is threadedly attached to the running tool 60 when the milling guide assembly 36 is conveyed into the well.

The lower wireline 64 is sealingly engaged by a packing gland 78 in an upper end of the running tool 60. The packing gland 78 thus seals off an inner axially extending flow passage 80 in which the lower wireline 64 is disposed. The flow passage 80 is in fluid communication with a series of circumferentially spaced apart and radially extending ports 82 (only one of which is visible in FIG. 3B) formed through a crossover member 84. The ports 82 are, in turn, in fluid communication with a series of circumferentially spaced apart ports 86 formed radially through an upper housing 88 of the running tool 60. Thus, the flow passage 80 is in fluid communication with the exterior of the running tool 60, and when the milling guide assembly 36 is disposed within the well, the flow passage is in fluid communication with an annulus formed radially between the running tool and the wellbore.

The crossover 84 is sealingly received in the housing 88 and has a series of circumferentially spaced apart and axially extending ports 90 formed therethrough. The ports 90 provide fluid communication for an axially extending fluid passage 92 formed in the running tool 60 radially between the housing 88 and a tube 94 containing the flow passage 80. The tube 94 is sealingly received in the crossover 84.

As described above, fluid is circulated through the running tool 60 to set the anchoring device 62 and to decouple therefrom. When the milling guide assembly 36 has been positioned relative to the whipstock 22 (or the liner portion 32 extending laterally across the parent wellbore 14, the fluid (indicated by arrows 96) is pumped downwardly through the tubing string 38, axially through the wet connect 52, and through the fluid passage 92. It may now be seen that the crossover 84 provides fluid communication between the interior of the tubing string 38 and the fluid passage 92.

Figure 3A:
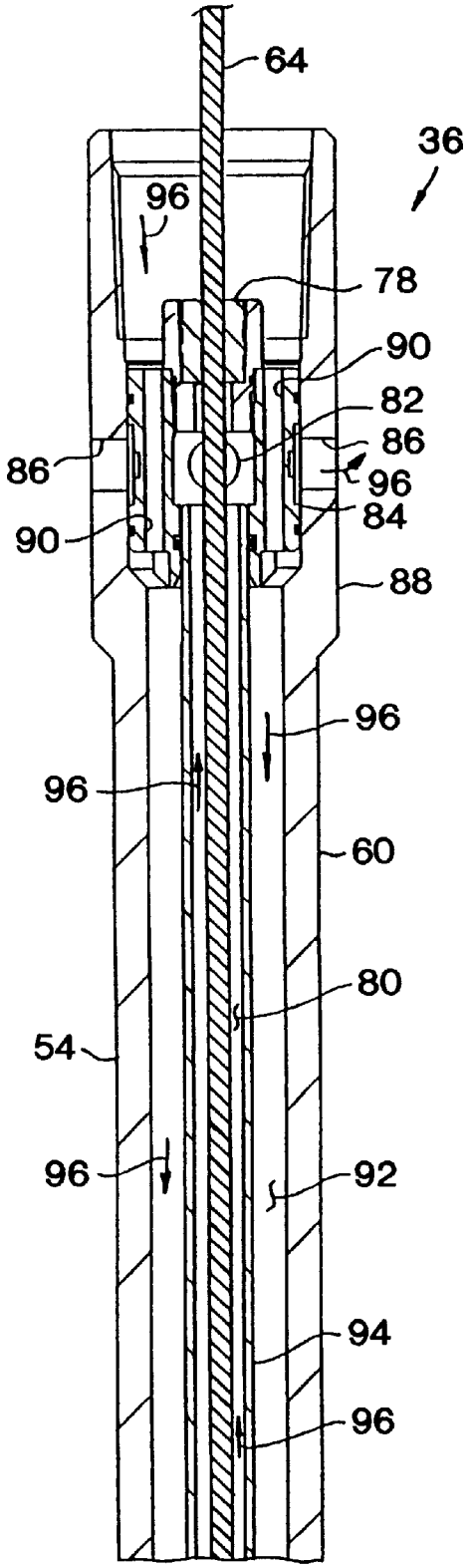
FIGS. 3A–3K are cross-sectional views of successive axial portions of an embodiment of the milling guide assembly.
Figure 3B:
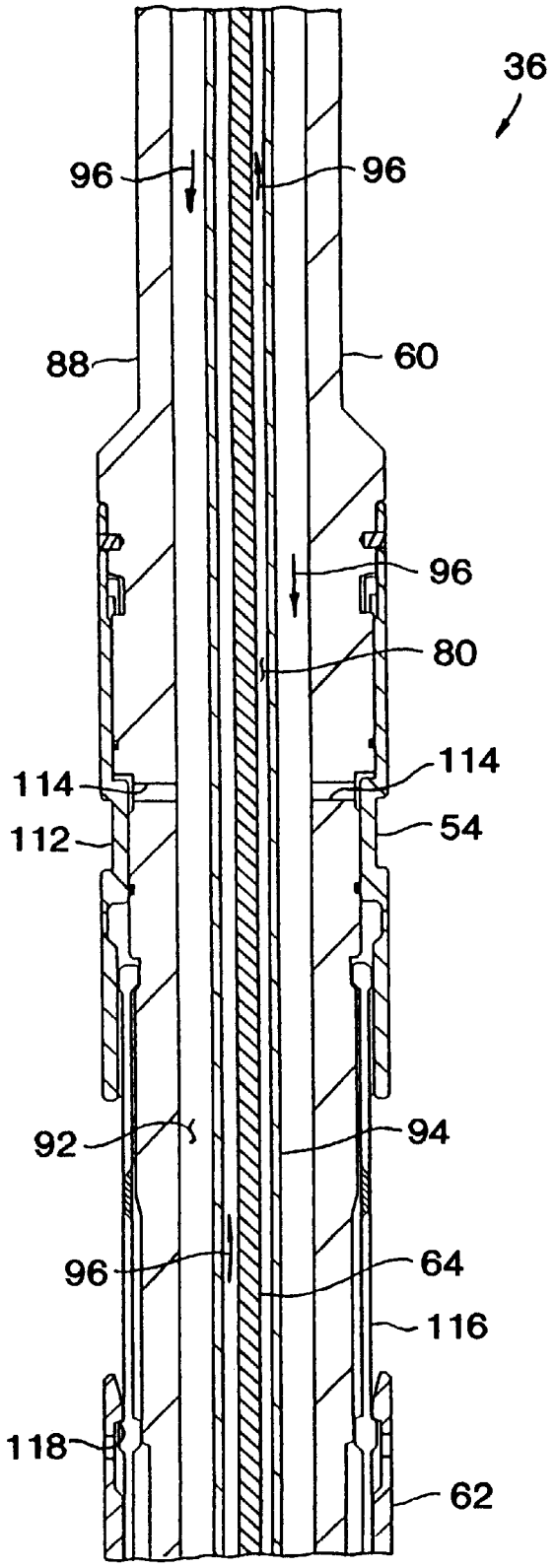
Figure 3C:
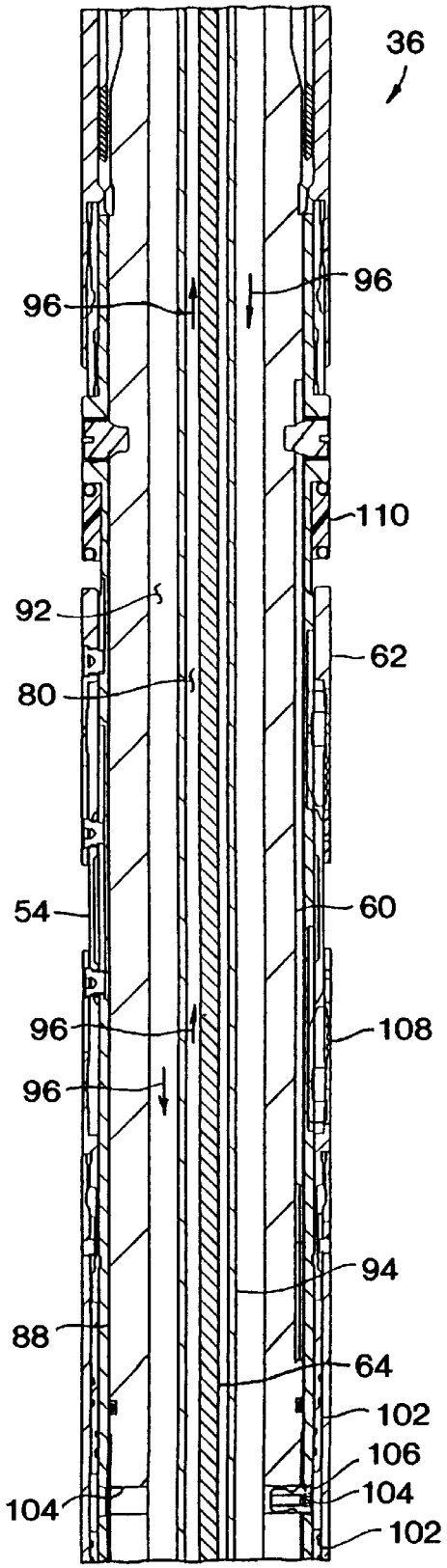
Figure 3D:
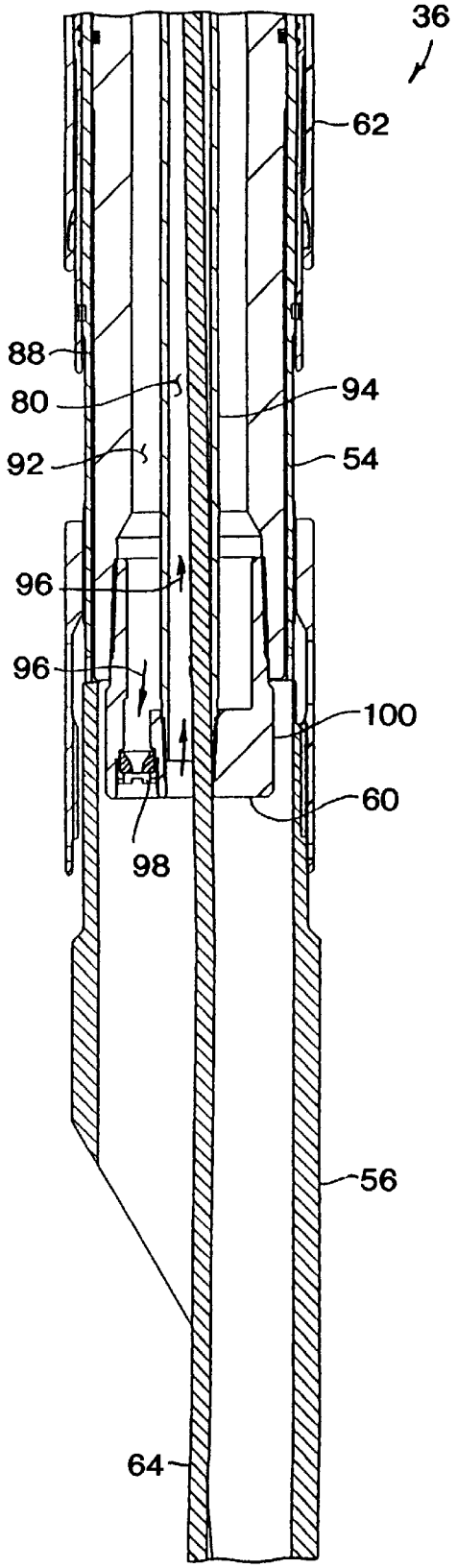
Figure 3E:
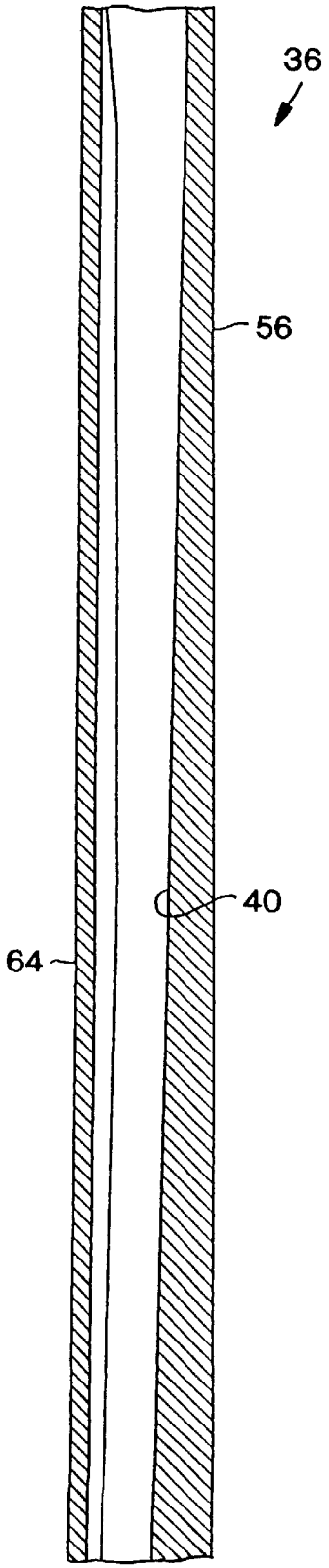
Figure 3F:
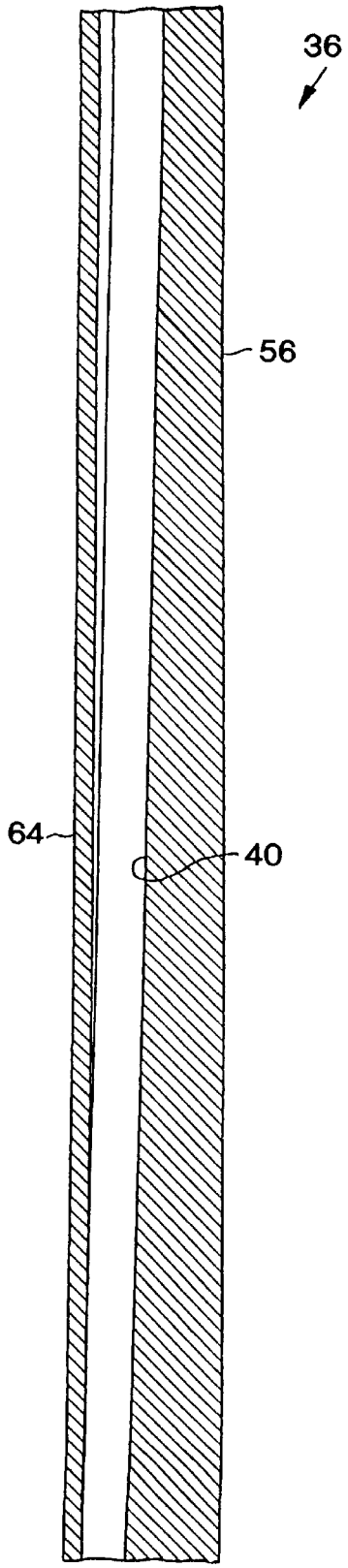
Figure 3G:
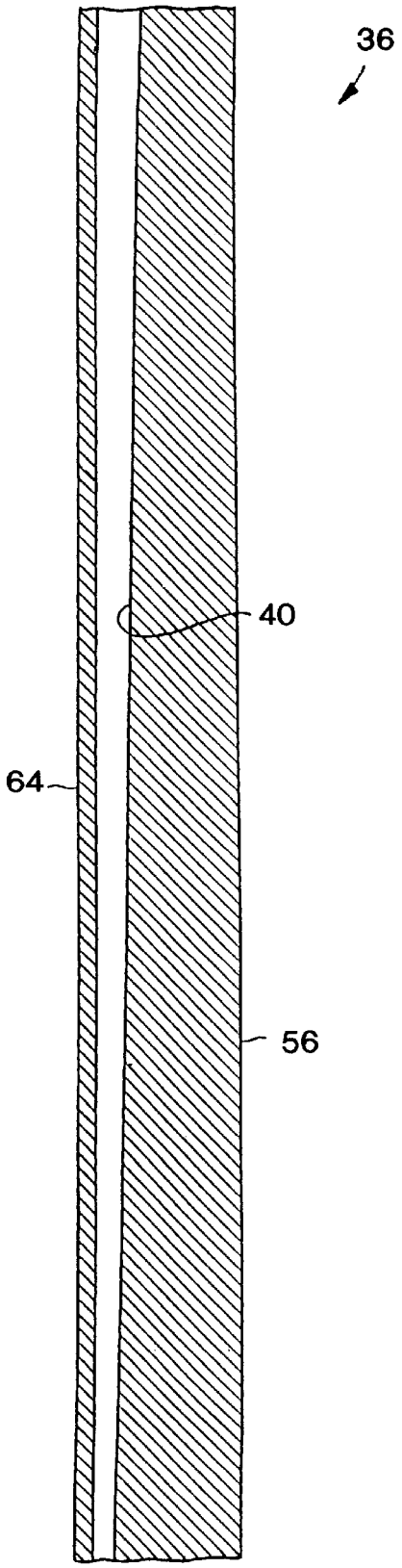
Figure 3H:
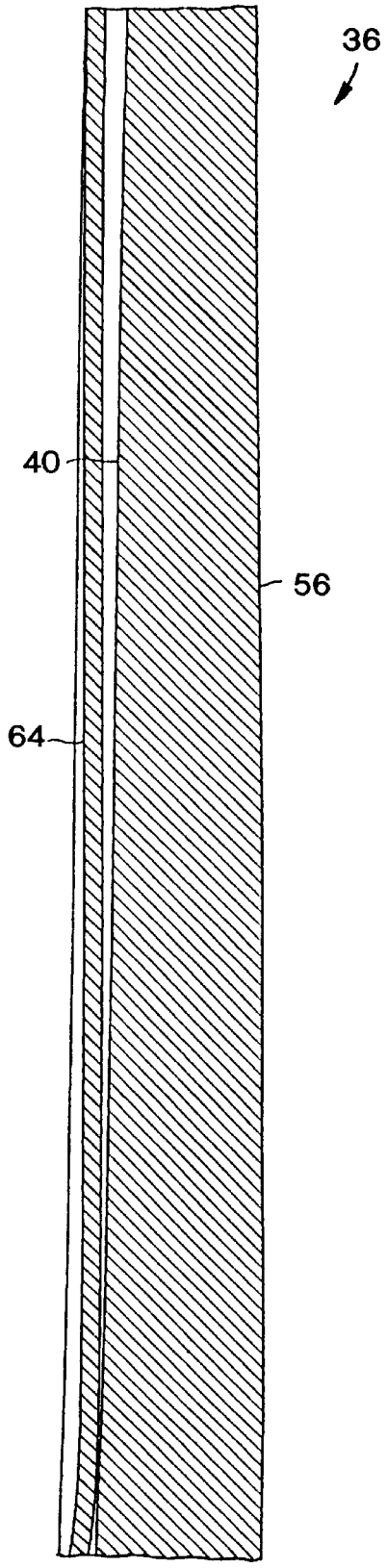
Figure 3I:
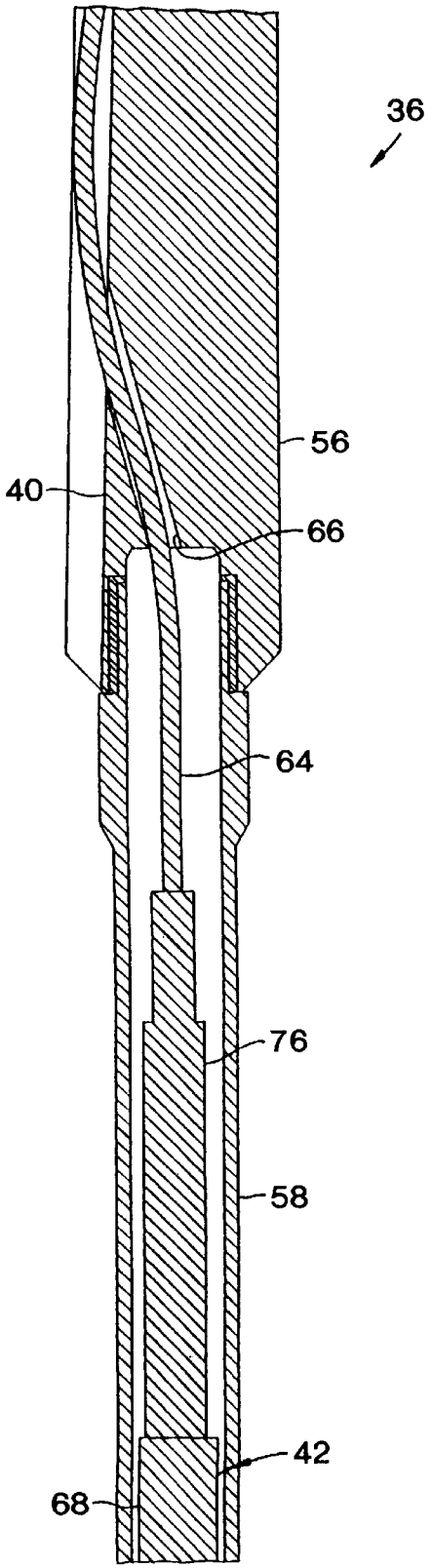
Figure 3J:
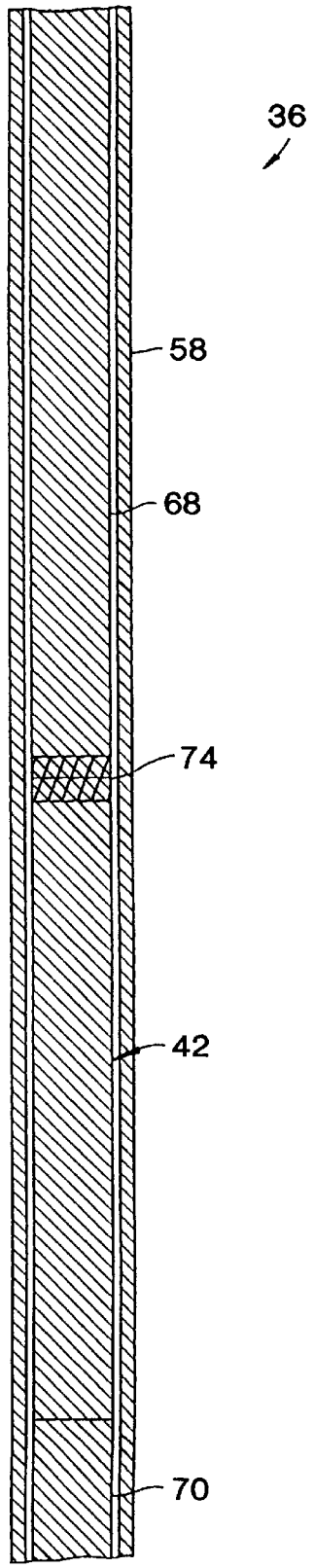
Figure 3K:
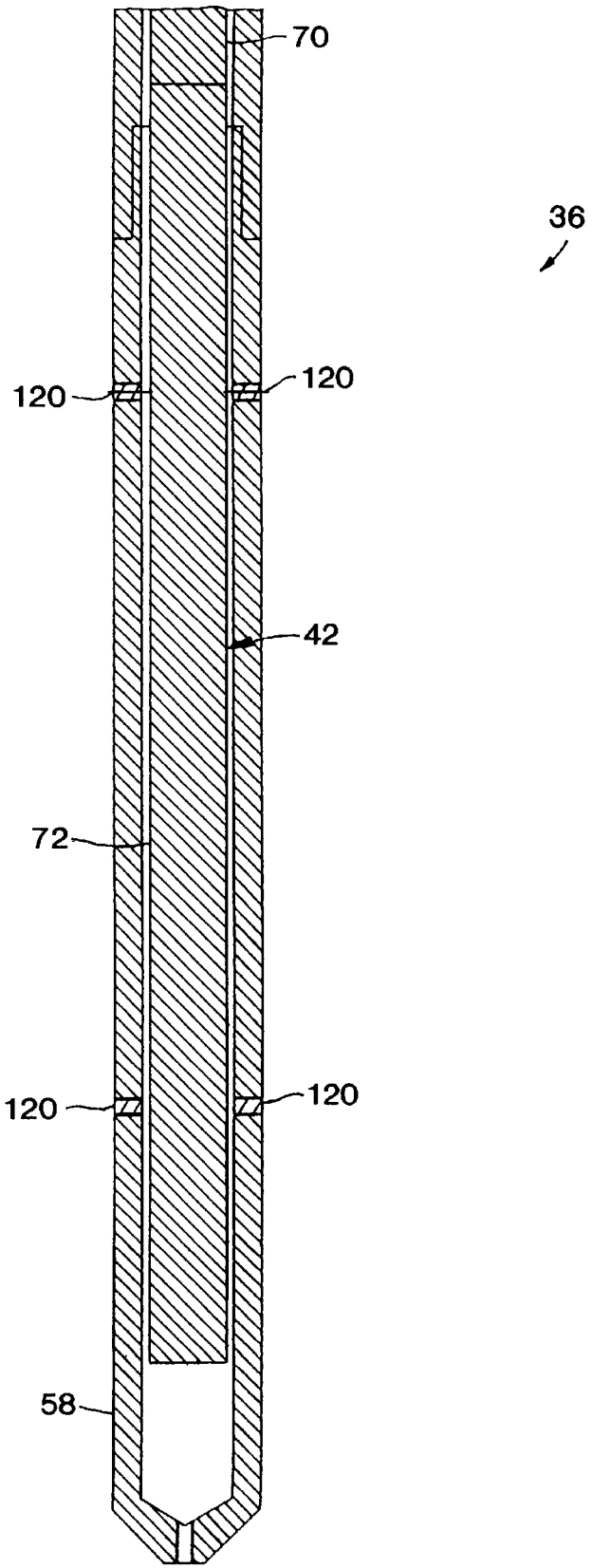

At a lower end of the fluid passage 92, an orifice 98 is threadedly installed in a bottom sub 100 of the running tool 60 (see FIG. 3D). After the fluid 96 has passed through the orifice 98, it may return to the earth's surface via the annulus formed between the running tool 60 and the parent wellbore 14 by flowing upwardly through the flow passage 80, through the crossover ports 82, and radially outward through the housing ports 86 to the exterior of the running tool. Thus, the fluid 96 is circulated through the running tool 60 by flowing it downwardly through the fluid passage 92, through the orifice 98, and upwardly through the flow passage 80.

When the fluid 96 flows through the orifice 98, the flow is restricted, thereby producing a pressure drop across the orifice. This pressure drop is manifest in an increased fluid pressure in the fluid passage 92 relative to the fluid pressure in the flow passage 80. Therefore, a differential fluid pressure is created from the fluid passage 92 to the flow passage 80. An increase in the rate of flow of the fluid 96 produces an increase in the pressure differential, and a decrease in the flow rate produces a decrease in the differential pressure.

The anchoring portion 62 is of conventional design. It is a hydraulically set anchor having opposing pistons 102 in fluid communication with the fluid passage 92 via ports 104 formed radially through the running tool housing 88. A hollow plug 106 maintains alignment between the running tool 60 and the anchoring device 62 at the ports 104.

When the fluid pressure differential is increased to a first predetermined level, the upper piston 102 displaces axially upward, radially outwardly extending a set of circumferentially spaced apart slips 106 (only one of which is visible in FIG. 3C), and axially compressing a circumferential seal element 110, thereby setting the anchoring device 62. In the method 10, the anchoring device 62 is set in the liner 28 (the slips 108 grippingly engaging the liner and the seal element 110 sealingly engaging the liner) after the milling guide 56 has been appropriately positioned relative to the whipstock 22.

When it is desired to decouple the running tool 60 from the anchoring device 62, the fluid pressure differential is increased to a second predetermined level. This second pressure differential shifts an outer sleeve 112 carried on the housing 88 downwardly. The sleeve 112 is in fluid communication with the fluid passage 92 via ports 114 formed radially through the housing 88. Such downward displacement of the sleeve 112 permits collets 116 to be released from an internal annular recess 118 formed in an upper end of the anchoring device 62, thereby decoupling the running tool 60 from the anchoring device and permitting relative displacement therebetween.

The lower wireline 64 extends downwardly from the flow passage 80 through the bottom sub 100. The milling guide 56 is threadedly attached to the anchoring device 62, and the lower wireline 64 extends through an upper tubular portion of the milling guide where it attaches to the anchoring device. The milling guide 56 includes the guide surface which, as representatively illustrated in FIGS. 3F–3I, is laterally inclined and generally concave in shape. This shape aids in guiding a cutting tool to laterally deflect toward the liner portion 32, and to cut into the liner portion.

The opening 66 is formed through the milling guide 56 intersecting the guide surface 40, as shown in FIG. 31. This configuration of the milling guide 56 provides a degree of protection to the lower wireline 64 as the milling guide assembly 36 is conveyed into the well and positioned therein. However, it is to be clearly understood that the lower wireline 64 may be other-wise routed, without departing from the principles of the present invention. For example, the opening 66 could be formed axially through the milling guide 56, without intersecting the guide surface 40, or the lower wireline 64 could be disposed in a recess formed externally on the milling guide, etc.

The housing 58 is threadedly attached to a lower end of the milling guide 56. The lower wireline 64 passes into the interior of the housing 58 through the opening 66, and is operatively connected to the rope socket 76. The rope socket 76 interconnects the lower wireline 64 to the logging tool 42 as described above.

The logging tool 42 is contained in the housing 58 and secured relative thereto. For securing the logging tool 42 relative to the housing 58, set screws 120 are installed radially through the housing. Note that the axial position of the logging tool 42 relative to the housing 58 may be adjusted using the set screws 120, so that a desired distance is obtained between the sensor location 74 and the guide surface 40, or some other portion of the milling guide assembly 36. Of course, it will be readily appreciated that the logging tool 42, or any portion thereof, may be incorporated into the milling guide 56 itself, or made an integral part of the housing 58, so that the distance between the sensor location 74 and the guide surface 40, or any other portion of the milling guide assembly 36, is fixed and fewer elements are needed for the complete milling guide assembly. Thus, the logging tool 42 may be otherwise attached to the milling guide 56 without departing from the principles of the present invention.

Figure 4:
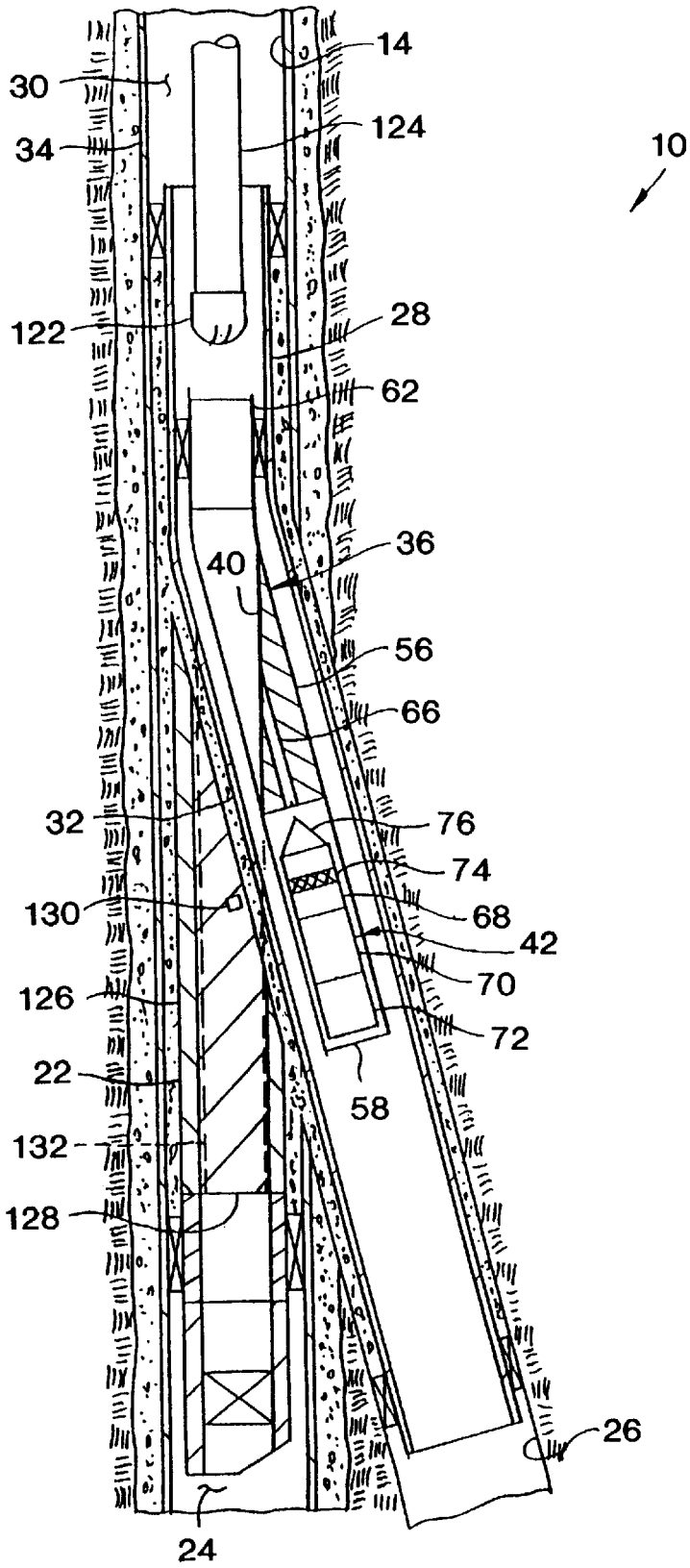
FIG. 4 is an enlarged schematic view of the method of FIG. 1, in which further steps of the method have been performed.

Referring additionally now to FIG. 4, the method 10 is schematically and representatively illustrated, further steps of the method having been performed as compared to that shown in FIG. 1. The milling guide assembly 36 has been positioned relative to the whipstock 22 and liner portion 32, that is, the milling guide 56 is at an appropriate depth within the liner 28, and the guide surface 40 is facing toward the liner portion. These positionings have been accomplished with the wireline 44 operatively engaged with the wet connect 52 as described above, thereby enabling communication between the logging tool 42 and the earth's surface.

With the milling guide assembly 36 appropriately positioned within the liner 28, a first predetermined pressure is applied to the running tool 60 to set the anchoring device 62 in the liner. Of course, it is not necessary, in keeping with the principles of the present invention, for the anchoring device 62 to be set in the liner 28. For example, the anchoring device 62 could be set above the liner 28 in the casing 34, and this may be advantageous where the parent wellbore 14 is highly deviated near the liner 28, so that the wet connect 52 may be positioned within a more vertical portion of the parent wellbore, to aid in conveyance of the wireline 44 to the wet connect.

With the anchoring device 62 set in the liner 28, the running tool 60 is decoupled from the anchoring device 62 by applying a second predetermined pressure to the running tool. The running tool 60 is then retrieved from the well, along with the tubing string 38, the wet connect 52, and the lower wireline 64. The lower wireline 64 is detached from the rope socket 76 by raising the tubing string 38 with the running tool 60 decoupled from the anchoring device 62, thereby applying an upwardly directed force to the lower wireline.

When the tubing string 38, wet connect 52, running tool 60, and lower wireline 64 have been retrieved from the well, one or more cutting tools 122 are lowered on a drill string 124 through the upper parent wellbore 30, inserted axially through the anchoring device 62, and engage the milling guide 56. The guide surface 40 contacts the cutting tool 122 and guides it to cut into the liner portion 32 overlying the whipstock 22. A series of cutting tools, including pilot mills, reamers, etc., may be used for the cutting tool 122, and the methods described more fully in U.S. patent application Ser. No. 08/680,740, entitled METHODS OF COMPLETING A SUBTERRANEAN WELL, filed Jul. 15, 1996, and incorporated herein by this reference, may be utilized for cutting through the liner portion 32 and/or whipstock 22.

Preferably, but not necessarily, the whipstock 22 includes an outer case 126 and an inner core 128. The inner core 128 is somewhat less hard than the outer case 126, so that it is relatively easily drilled through. Thus, in this preferred embodiment of the invention, the guide surface 40 should direct the cutting tool 122 to cut into the liner portion 32 directly overlying the inner core 128. For accurately positioning the milling guide 56 relative to the whipstock 22, a marker 130 is attached to the whipstock 22 a predetermined distance from the opening 132 to be formed through the whipstock by the cutting tool 122.

The marker 130 is preferably attached to the whipstock 22 before the whipstock is installed in the well. The marker 130 may be a radioactive source, or any other type of marker which may be detected by the logging tool 42. In the preferred embodiment, the logging tool 42 includes the gamma ray tool 68, so a radioactive "pip tag" is used for the marker 130. The marker 130 is shown in FIG. 4 embedded within the inner core 128, but it is to be understood that the marker may be otherwise positioned without departing from the principles of the present invention.

It will be readily appreciated that, as shown in FIG. 4, the guide surface 40 is aligned with the opening 132 to be formed through the whipstock 22, and the sensor location 74 is laterally opposite the marker 130. Thus, the cutting tool 122 will be guided to cut the opening 132 through the inner core 128, removing a substantial portion of the inner core from within the outer case 126. It will also be readily appreciated that, by adjusting the position of the marker 130 relative to the opening to be formed 132, or adjusting the distance 'A' between the sensor location 74 and the guide surface 40 (see FIG. 2), the position of the opening 132 relative to the whipstock 22 (or relative to the liner portion 32) may be easily adjusted.

Preferably, the sensor location 74 is laterally aligned with the marker 130 (producing the greatest signal via the wireline 44 at the earth's surface) when the guide surface 40 is aligned with the opening to be formed 132 through the whipstock 22. For this purpose, the position of the marker 130 relative to the opening to be formed 132 corresponds to (but is not necessarily equal to) the position of the sensor location 74 relative to the guide surface 40. In this manner, the milling guide 56 may be anchored relative to the liner 28 when the sensor location 74 is laterally opposite the marker 130, without requiring any repositioning of the milling guide. This significantly enhances the accuracy and convenience of positioning the milling guide 56 relative to the whipstock 22.

After the opening 132 has been formed through the liner portion 32 and whipstock 22, cutting tool 122 and drill string 124 are removed, and the milling guide 56, anchoring device 62, housing 58 and logging tool 42 are retrieved from the well using conventional methods. For example, the lower milling guide assembly 36 may be retrieved by spearing the anchoring portion 62 with a conventional fishing tool (not shown).

Retrieval of the lower milling guide assembly 36 is enhanced by the seal element 110 (see FIG. 3C), which sealingly engages the liner 28 and forms a debris barrier radially between the anchoring device 62 and the liner above the slips 108. This prevents cuttings from the milling and drilling operations from accumulating about the slips 108 and other portions of the lower milling guide assembly 36. Note that sealing engagement between the seal element 110 and the liner 28 is not required for the seal element to form a debris barrier.

In summary, the method 10 is performed by installing the whipstock 22 in the lower parent wellbore 24, with the marker 130 appropriately positioned relative to the opening to be formed 132. The lateral wellbore 26 is then drilled and the liner 28 is installed and cemented in place extending through the intersection of the parent and lateral wellbores 14, 26. The milling guide assembly 36 is then conveyed into the liner 28, and the wireline 44 is lowered through the tubing string 38 and connected to the wet connect 52. The milling guide assembly 36 is positioned relative to the liner portion 32 and whipstock 22 using the logging tool 42, a sensor location 74 on the logging tool being positioned relative to the guide surface 40, and the sensor location preferably being laterally opposite the marker 130 when the guide surface 40 is aligned with the opening to be formed 132. The anchoring device 62 is then set in the liner 28 by applying a first predetermined pressure to the running tool 60, and the running tool is decoupled from the anchoring portion 62 by applying a second predetermined pressure to the running tool. The wireline 44 is retrieved from the well, before or after the running tool 60 is decoupled from the anchoring device 62. The tubing string 38 is then retrieved from the well, thereby also retrieving the wet connect 52, running tool 60, and lower wireline 64 therewith. The cutting tool 122 is then lowered into the well on the drill string 124 and guided to cut through the liner portion 32 by the guide surface 40. After the opening 132 has been formed through the whipstock 22, the lower milling guide assembly 36 is retrieved from the well.

Of course, a person of ordinary skill in the art would find it obvious to make modifications, additions, deletions, substitutions, and other changes to the method 10 and milling guide assembly 36 described above, and these changes are contemplated by the principles of the present invention. Accordingly, the foregoing detailed description is to be clearly understood as being given by way of illustration and example only, the spirit and scope of the present invention being limited solely by the appended claims.

What is claimed is:

1. A milling guide assembly, comprising:

a milling guide;

a wireline extending through an opening formed in the milling guide;

and a tool attached to the milling guide and electrically coupled to the wireline.

2. The milling guide assembly according to claim 1, further comprising a releasable coupling attached to the milling guide, the wireline extending through the releasable coupling.

3. A milling guide assembly, comprising:

a milling guide;

a wireline extending through the milling guide; and a weak point connected to the wireline, the weak point permitting removal of the wireline from the milling guide.

4. A milling guide assembly, comprising:

a milling guide;

a wireline extending through the milling guide; and a logging tool attached to the milling guide and operatively connected to the wireline.

5. A milling guide assembly, comprising:

a milling guide;

a wireline extending through the milling guide;

a releasable coupling attached to the milling guide, the wireline extending through the releasable coupling; and a wireline wet connect attached to the releasable coupling.

6. The milling guide assembly according to claim 5, wherein the releasable coupling is interconnected between the wet connect and the milling guide.

7. A method of positioning a milling guide relative to a whipstock disposed in a lower portion of a parent wellbore, a liner overlying the whipstock and extending into an upper portion of the parent wellbore and extending into a lateral wellbore intersecting the parent wellbore, the method comprising the steps of:

attaching a marker to the whipstock;

conveying the milling guide into the liner, a logging tool being attached to the milling guide;

detecting the marker with the logging tool; and positioning the logging tool relative to the marker.

8. The method according to claim 7, further comprising the step of using the milling guide to guide a cutting tool to cut through a portion of the liner overlying the whipstock.

9. The method according to claim 8, further comprising the step of forming an opening through an inner core of the whipstock, the inner core underlying the liner portion and having a hardness different from that of an outer case of the whipstock.

10. The method according to claim 7, wherein in the attaching step, the marker is positioned a first predetermined distance from an opening to be formed on the whipstock.

11. The method according to claim 10, wherein in the attaching step, the distance corresponds to a second predetermined distance between the logging tool and a guide surface of the milling guide.

12. The method according to claim 7, wherein the positioning step further comprises positioning the milling guide relative to the whipstock.

13. The method according to claim 12, wherein the milling guide positioning step further comprises aligning a guide surface of the milling guide with a portion of the liner overlying the whipstock.

* * * * *